US008506721B2

(12) United States Patent
Choi

(10) Patent No.: US 8,506,721 B2
(45) Date of Patent: Aug. 13, 2013

(54) DISH WASHER AND CONTROLLING METHOD THEREOF

(75) Inventor: Kwang Pyo Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1437 days.

(21) Appl. No.: 11/790,437

(22) Filed: Apr. 25, 2007

(65) Prior Publication Data

US 2007/0251546 A1 Nov. 1, 2007

(30) Foreign Application Priority Data

Apr. 25, 2006 (KR) ..... 10-2006-0037002

(51) Int. Cl.
*B08B 7/00* (2006.01)

(52) U.S. Cl.
USPC ..... 134/19; 134/18; 134/25.2; 134/30

(58) Field of Classification Search
None
See application file for complete search history.

(56) References Cited

U.S. PATENT DOCUMENTS 6,276,373 B1 * 8/2001 Gotfried ..... 134/22.1

FOREIGN PATENT DOCUMENTS

| | | | |
|---|---|---|---|
| CN | 1183943 | A | 6/1998 |
| DE | 3513639 | A1 | 10/1986 |
| JP | 3066268 | B2 | 5/1996 |

* cited by examiner

*Primary Examiner* — Eric Golightly
(74) *Attorney, Agent, or Firm* — Birch, Stewart, Kolasch & Birch, LLP

(57) ABSTRACT

A method of controlling a dish washer includes performing a wash cycle for washing dishes with wash liquid and performing a rinse cycle for rinsing the washed dishes. Cold water is supplied to a sump after completion of the rinse cycle, the cold water lowering the temperature with a tub. After completion of supplying the cold water, a drying cycle for drying an inside of the tub is performed.

6 Claims, 3 Drawing Sheets

DISH WASHER AND CONTROLLING METHOD THEREOF

The present application claims priority under 35 U.S.C. 119 and 35 U.S.C. 365 to Korean Patent Application No. 10-2006-0037002 (filed on Apr. 25, 2006), which is hereby incorporated by reference in its entirety.

BACKGROUND

1. Field

This disclosure relates to a dish washer for washing dishes and a controlling method of a dish washer.

2. Description of the Related Art

A dish washer is a home appliance that washes food residue from the surfaces of dishes by spraying wash liquid at high pressure through spray nozzles.

A dish washer includes a tub forming a wash compartment, a sump provided at the bottom of the tub for storing wash liquid, and other components. Wash liquid flows to spray nozzles and arms connected to the sump, by means of a pumping action of a wash pump installed in the sump, and the wash liquid that flows to the spray nozzles/arms is sprayed at high pressure through spray holes defined in the ends of the spray nozzles/arms.

A dishwashing course includes a wash cycle in which impurities such as food deposits on dishes are washed away, a rinse cycle in which dishes are rinsed following the wash cycle, and a drying cycle in which moisture on the surfaces of dishes is removed following the rinse cycle.

SUMMARY

An implementation of a dish washer and is a method of controlling a dish washer. The dish washer including: a tub forming a wash compartment; a sump provided at a side of the tub for storing wash liquid; a water supply valve for supplying wash liquid to the sump; a controller for controlling an on/off state of the water supply valve and supplying cold water into the tub before a drying cycle; a memory in which data on a wash course that is sent to the controller is stored; and a driver for at least driving a drain pump according to the controller.

DETAILED DESCRIPTION

Figure 1:
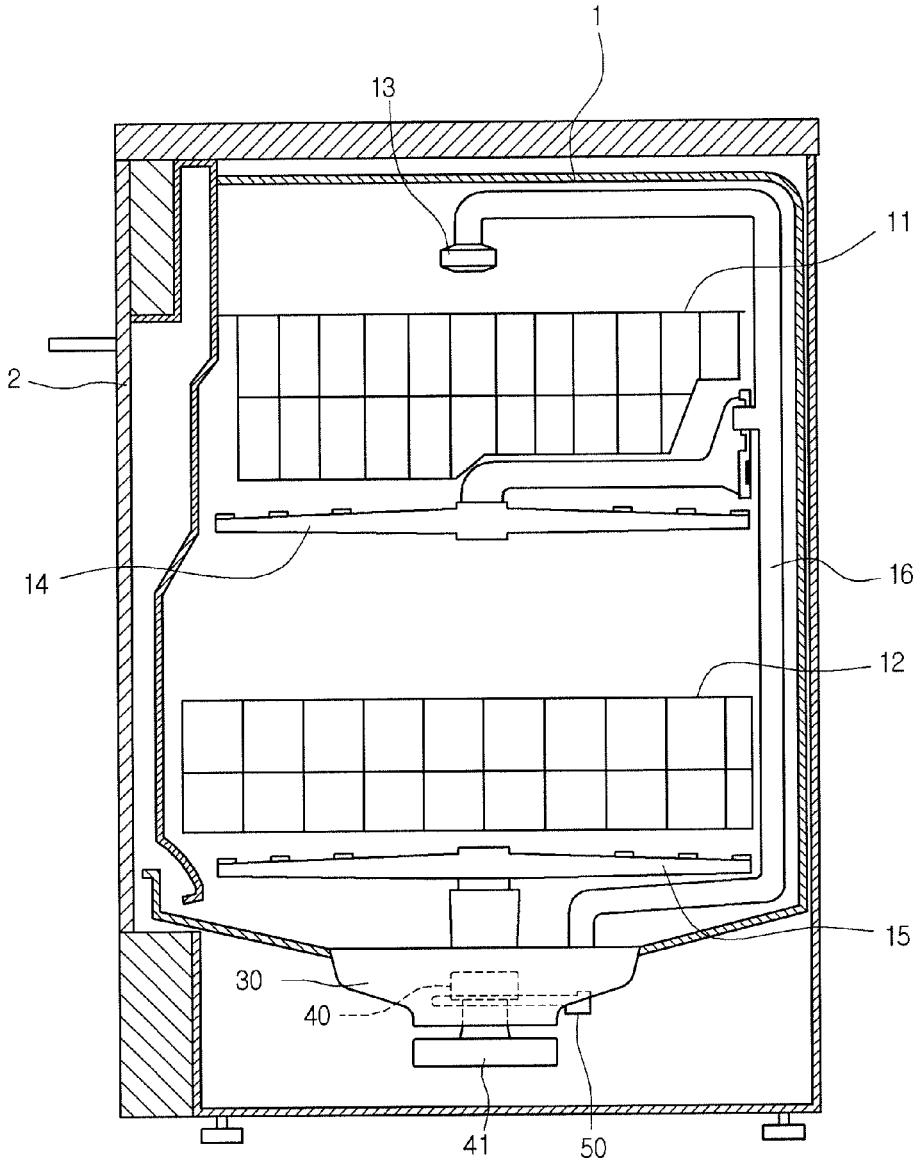
Fig.1 PRIOR ART
FIG. 1 is a side sectional schematic view of a dish washer.

FIG. 1 is a side sectional schematic view of a dish washer.

Referring to FIG. 1, a dish washer includes a tub 1 forming a wash compartment, a door 2 provided at the front of the tub 1 for selectively opening and closing the tub 1, a sump 30 provided at the lower central portion of the tub 1 for storing wash liquid, and a heater 50 installed within the sump 30 for heating the wash liquid to a high temperature.

Also, the dish washer includes a wash pump 40 connected to the sump 30 for pumping the wash liquid stored within the sump 30 at high pressure, and a wash motor 41 connected to the wash pump 40 for driving the wash pump 40.

Furthermore, although not shown, a drain pump and a drain motor are coupled to the sump 30 to drain wash liquid.

In further detail, an upper rack 11 and a lower rack 12 are provided within the tub 1 to store dishes and slide in and out of the tub 1, and a top nozzle, an upper spray arm 14, and a lower spray arm 14 are provided to spray wash liquid toward the upper and lower racks 11 and 12.

Also, the lower spray arm 15, which is connected to an upper central portion of the sump 30, is provided below the lower rack 12 to spray wash liquid upward.

The top nozzle 13 and the upper spray arm 14 are connected to the sump 30, and are supplied with wash liquid from the sump 30 through a water guide 16. That is, the water guide 16 provides a passage for wash liquid stored in the sump 30 to flow to the top nozzle 13 and the upper spray arm 14.

The upper spray arm 14 is provided between the upper and lower racks 11 and 12, and sprays water toward the upper rack 11, and the top nozzle 13 is provided above the upper rack 11 and sprays wash liquid toward the upper rack 11.

A description will be given below of the operation of the dish washer.

First, a user opens the door 2 of the dish washer, and pulls one or both of the upper and lower racks 11 and 12 out from the tub 1 in a frontward direction. After dishes are placed in the upper and lower racks 11 and 12, the door 2 is closed and power is applied to activate the dish washer.

Then, when the power applied to the dish washer operates a wash cycle, wash liquid enters the sump 30 from an outside thereof.

When a predetermined quantity of wash liquid fills the inside of the sump 30, the wash motor 50 beings to operate. The wash pump 40 that is connected through a shaft to the wash motor 50 rotates its impellers (not shown) that are provided within, so that wash liquid is alternately pumped to the lower spray arm 15 or the water guide 16.

The wash liquid that is pumped to the water guide 16 flows to the top nozzle 13 and the upper spray arm 14, and is sprayed into the wash compartment. The sprayed wash liquid washes the dishes stored in the racks 11 and 12.

Here, spray holes (not shown) may be formed in the bottom surface of the upper spray arm 14, so that wash liquid can be sprayed both upward and downward, thereby washing the top surfaces of dishes in the lower rack 12 at the same time.

The contaminated wash liquid that collects in the sump 30 during the wash cycle is filtered of impurities by a filter (not shown). The wash liquid that is filtered of impurities is drained by a draining pump (not shown) to the outside of the dish washer.

When the wash cycle is completed, clean wash liquid discharged through the top nozzle 13 and the upper and lower spray arms 14 and 15 rinses the dishes in a drain cycle. Here in the drain cycle, the heater 50 heats the wash liquid, so that heated wash liquid is sprayed into the wash compartment. When the rinse cycle is completed, the drying cycle begins.

Here, at the completion of the rinse cycle, a draining of wash liquid begins. When the draining is completed, a cold water supplying cycle is performed right before the drying cycle is started. That is, in the cold water supplying cycle, wash liquid is supplied into the sump 30.

At the completion of the drying cycle, a draining cycle is implemented. That is, in the draining cycle, the wash liquid that was supplied to the sump 30 in the cold water supplying cycle is discharged to the outside.

Figure 2:
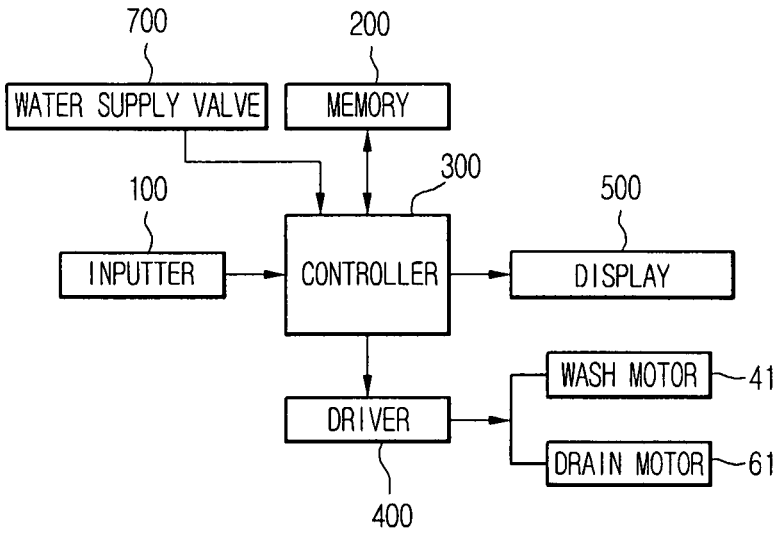
FIG. 2 is a block diagram of components of a dish washer.

FIG. 2 is a block diagram of components of a dish washer.

Referring to FIG. 2, a dish washer according to the present embodiment includes an input part 100 for inputting wash courses, draining and water supplying preferences, etc., a driver 400 for driving the wash motor 41 and the drain motor 61, a memory 200 in which various data including the water supply and draining preferences entered through the input part 100 are stored, a controller 300 for setting the overall steps of a wash course according to the data stored in the memory 200, a water supply valve 700 that is opened and closed by the controller 300, and a display 500 for displaying stages of a course and/or the estimated time for performing the entire wash course.

In detail, when a user inputs water supply and drain cycle settings through the input part 100, the inputted values are included in the overall course and is stored in the memory 200.

Also, the controller 300 measures the duration of the overall wash course and for each stage thereof, based on the data stored in the memory 200. Based on the determining of the controller, the washing duration and those of each stage, including the water supply and draining courses, is displayed on the display 500.

In other words, the controller 300 measures the overall wash time and the time for each stage including the draining and water supply stages, and the controller 300 controls the operation of the driver 400. When the wash motor 41 connected to the driver 400 operates, the wash pump 40 also operates.

The water supply valve 700 opens and closes according to the controlling of the controller 300 to perform supplying and draining of wash liquid. Here, the water supply valve 700 and/or the wash motor 41 operate(s) according to the sequence determined by the controller 300.

A detailed description of the operation of the dish washer will be provided below.

Figure 3:
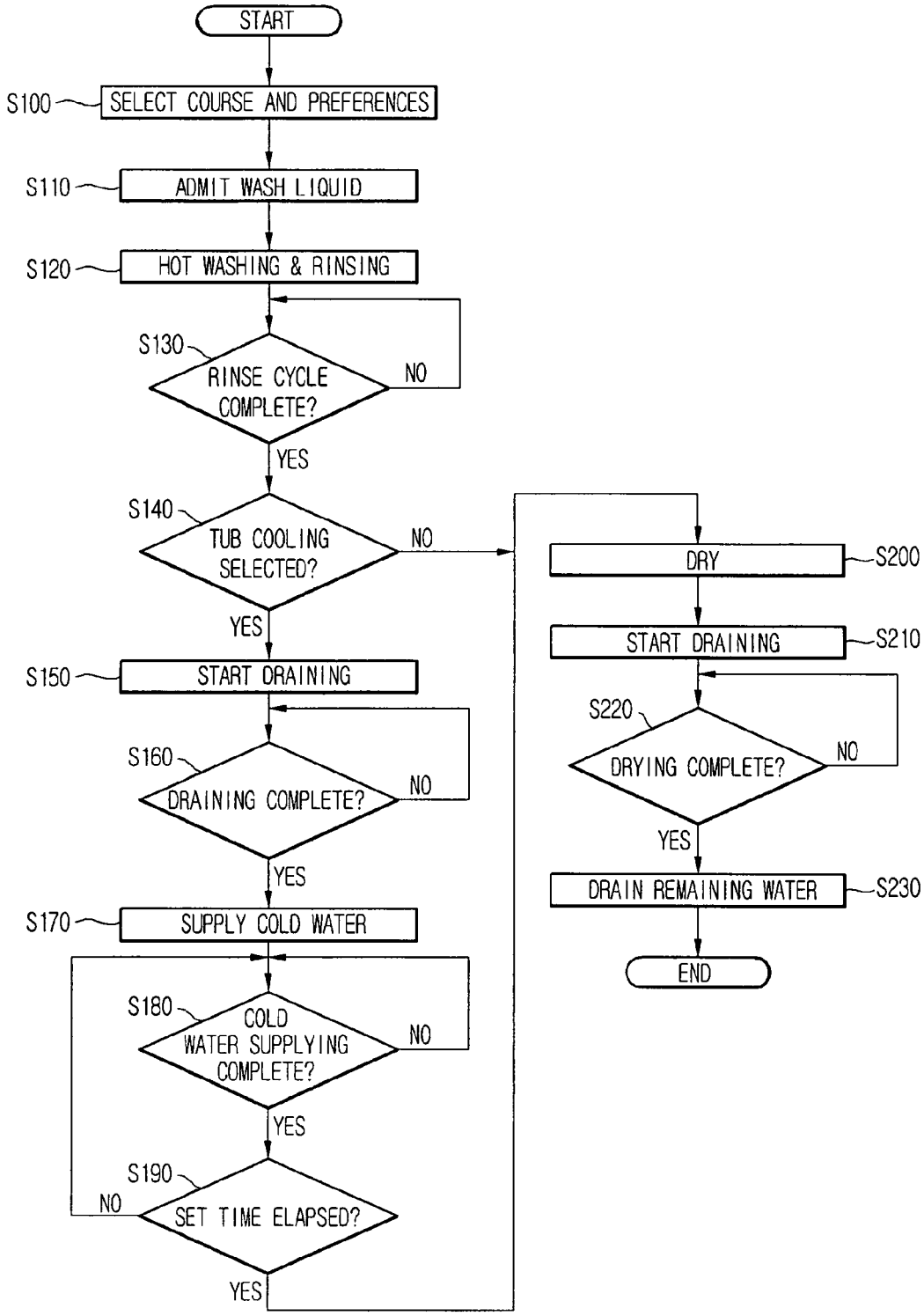
FIG. 3 is a flowchart of a controlling method of a dish washer.

FIG. 3 is a flowchart of a controlling method of a dish washer.

Referring to FIG. 3, first, when a user selects a course and preferences including a hot wash cycle, water supply cycle, and drying cycle, and enters the selections using a start button in step S100, wash water flows into the sump 30 in step S110.

The controller 300 also operates the heater 50 to heat the wash liquid stored in the sump 30 to implement a hot wash cycle for removing impurities from dishes through pumping and spraying wash liquid at high pressure.

When the hot wash cycle is completed, the wash liquid used for washing dishes is drained out from the dish washer, and the water supply valve 700 is opened to allow fresh wash liquid to enter and perform the rinse cycle in which the wash liquid is sprayed within the tub 1 in step S120.

Subsequently, it is determined in step S130 if the hot wash cycle and the rinse cycle have been completed. Here, when the rinse cycle is determined to have been completed, the next step is performed, and if the rinse cycle is determined not to have been completed, the hot wash cycle and the rinse cycle are performed again.

When the rinse cycle is completed, it is determined in step S140 if a tub cooling process according to the present embodiment has been selected. That is, when the course and preferences are selected by a user and the start button is pressed in step S100, the controller 300 determines whether the user has selected a tub cooling step by reading from the memory 200.

When it is determined that the tub cooling step has not been selected, the fan motor operates to rotate a drying fan to perform drying in step S200, and simultaneously, step S210 is performed in which draining of wash liquid begins. When the drying cycle begins, the steam generated during the rinse cycle is discharged to the outside.

On the other hand, if it is determined that the tub cooling step was selected, after the rinse cycle is completed, draining of wash liquid begins in step S150. It is then determined in step S160 whether the draining is completed; and if it is determined that draining has been completed, the water supply valve 700 is opened to allow cold water to be supplied into the sump 30 in step S170. Then, it is determined in step S180 whether the supply of cold water has been completed.

When it is determined that the supply of cold water is completed, step S190 is performed, in which it is determined whether a set time has been exceeded for holding the cold water in the sump 30.

Here, the set time is a time that is preset by the user in step S100 when the course and preference selections are set. When the set time is exceeded, the fan motor is operated to perform the drying cycle in step S200, and the draining cycle in step S210. That is, the cold water supplied into the sump 30 is drained in step S210.

Here, the supply of cold water may be completed before the drying cycle, or the supply of cold water may be performed during the drying cycle, according to the present embodiment.

Next, it is determined in step S220 whether the drying cycle has been completed. After it is determined that the drying cycle has been completed, wash liquid in the sump 30 and within the tub 1 is drained in a draining step S230. Here, condensed water is included in the remaining water. When the draining step is completed, the entire wash course is completed.

When the above rinse cycle has been completed, and cold water is supplied into the sump 30 before the start of the drying cycle, as hot water falls to the floor of the tub 1, steam that is generated during the rinse cycle can be condensed on the floor of the tub 1.

By condensing the steam prior to the implementing of the drying cycle, the forming of water droplets on dishes after the drying cycle can be prevented.

Also, by condensing the steam prior to the implementing of the drying cycle, the quantity of steam discharged to the outside of the dish washer can be reduced.

What is claimed is:

1. A method of controlling a dish washer, comprising:

performing a wash cycle for washing dishes with wash liquid;

performing a rinse cycle for rinsing the washed dishes;

supplying cold water to a sump after completion of the rinse cycle, the cold water cooling a tub;

storing the cold water in the sump for a set duration;

initiating a drying cycle for drying an inside of the tub after elapse of the set duration; and draining the cold water in the sump to outside of the dish washer.

2. The method according to claim 1, wherein the draining of the cold water is performed during the drying cycle or after completion of the drying cycle.

3. The method according to claim 1, wherein the supplying of the cold water is completed before the drying cycle is started.

4. The method according to claim 1, further comprising performing a draining cycle before the supplying of the cold water.

5. The method according to claim 1, wherein the supplying of the cold water is selectively added by a user during an inputting of wash settings.

6. The method according to claim 1, wherein the supplied cold water is drained during the drying cycle, and draining is performed again after the drying cycle is completed and condensed water is discharged to an outside.

* * * * *